United States Patent [19]

Renshaw et al.

[11] 4,150,938

[45] Apr. 24, 1979

[54] CONTROL UNIT FOR A GAS BURNER

[75] Inventors: Edward J. Renshaw, Castle Douglas; Michael J. Blissett, Dalbeatie, both of Scotland

[73] Assignee: Steel Radiators Limited, Henley-on-Thames, England

[21] Appl. No.: 781,312

[22] Filed: Mar. 25, 1977

[30] Foreign Application Priority Data

Apr. 6, 1976 [GB] United Kingdom ..... 13939/76

[51] Int. Cl.[2] ..... F23N 5/20

[52] U.S. Cl. ..... 431/67; 431/71; 431/73; 431/74

[58] Field of Search ..... 431/71, 46, 73, 78, 431/79, 80, 67

[56] References Cited

U.S. PATENT DOCUMENTS

| | | | |
|---|---|---|---|
| 3,196,923 | 7/1965 | Selinder | 431/71 X |
| 3,393,039 | 7/1968 | Eldridge | 431/71 X |

*Primary Examiner*—Alan Cohan

*Attorney, Agent, or Firm*—Diller, Ramik & Wight

[57] ABSTRACT

A control system for a gas burner of a domestic hot water system has a normally closed gas valve for controlling the supply of gas to the burner, and an electric solenoid for actuating the valve when energized by current of a first predetermined value. The solenoid can be held open by a current of a second predetermined value lower than the first. The solenoid current is derived from a mains a.c. supply through two thermistors in series. One of these thermistors has a negative temperature coefficient of resistance and provides a short delay to the operation of the solenoid when heat is initially demanded. The second thermistor, having a positive temperature coefficient of resistance, controls the valve lift time, that is to say, the limited time during which gas is supplied to the burner for enabling an attempt to ignite the burner to be made. The valve lift time is automatically reduced if the system is still hot from a previous operation, thereby preventing a possible explosion hazard.

12 Claims, 2 Drawing Figures

Figure 1:
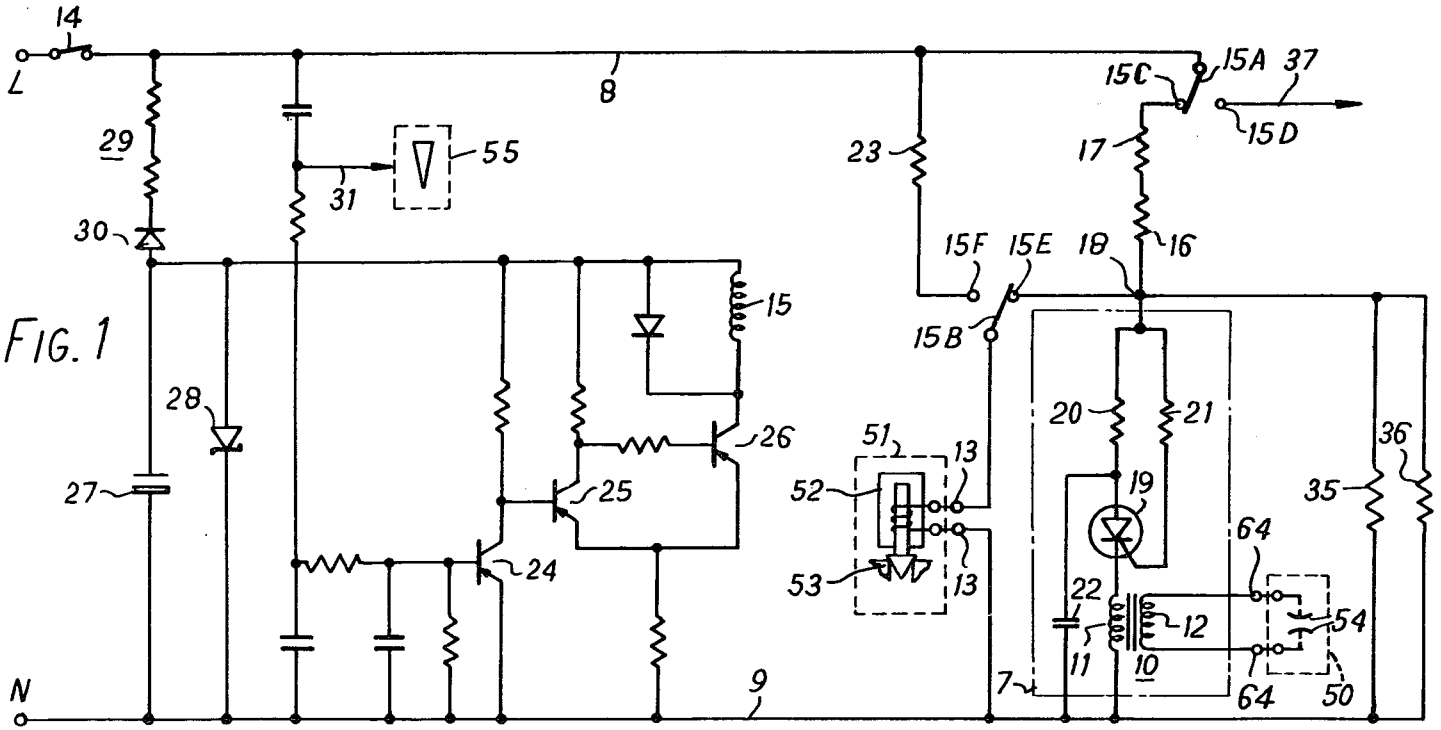

L
N
14
39
38
40
41
27
31
55
70
9
8
15
26
25
24
23
17
16
18
15E
15F
15B
51
52
53
7
66
67
65
10
11
12
22
19
50
54
64
64'
62
61
63
60

CONTROL UNIT FOR A GAS BURNER

This invention relates to control systems for controlling the supply of gas to a gas burner, particularly, but not exclusively, for a domestic hot water heating system.

An important object of the invention is to provide such a control system which, with suitable arrangement, combines safety of operation with cheapness, compactness and reliability.

In accordance with the invention from one aspect there is provided a control system for a gas burner, which comprises a normally closed valve for controlling the gas supply to the burner, and an electric solenoid connected to the valve, the solenoid being arranged for actuating the valve to its open condition when energized with a current of at least a first predetermined value, but capable of holding the valve open when energised with a current of at least a second predetermined value lower than the first, the system further including an electric circuit for energising the solenoid from an electric supply and arranged, on operation of the solenoid to open the valve, for controlling the solenoid current to vary from the first said predetermined value to below the second said predetermined value over a time period of substantial length, unless during said time period the burner is successfully ignited in which case the electric circuit is arranged to maintain the solenoid current at at least the second said predetermined value.

Figure 2:
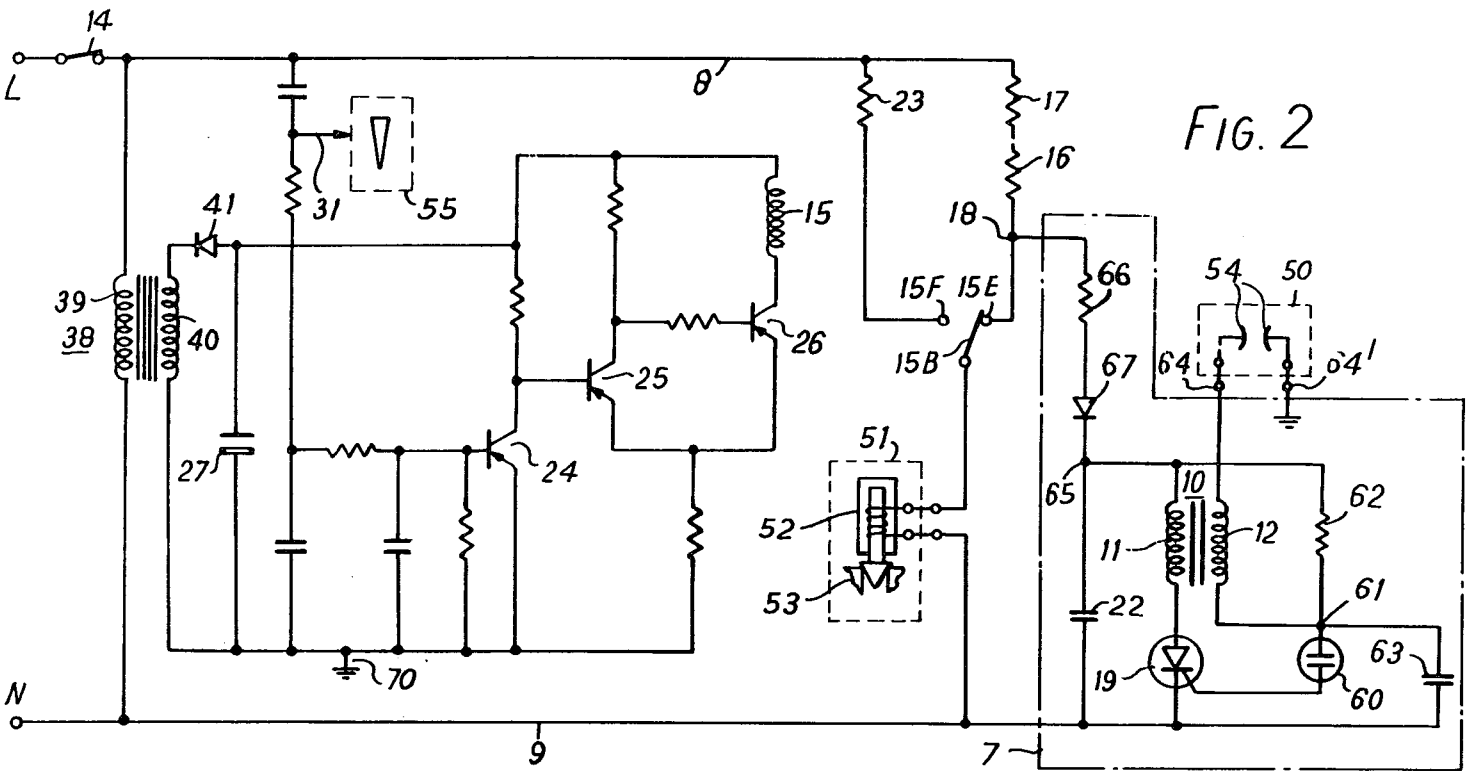

These and other aspects and features of the invention will become apparent from the following description of two embodiments thereof, given by way of example and with reference to the accompanying drawings. In the drawings:

FIG. 1 is the circuit diagram of the electric circuit arrangement of the first control system; and FIG. 2 similarly shows the electric circuit arrangement of the second control system.

Referring now to FIG. 1, the drawing shows the electric circuit arrangement of a system for controlling the supply of gas to a gas burner for a domestic hot water heating system. The circuit arrangement includes a spark ignition transformer 10 the high voltage secondary winding 12 of which has terminals 64 for connecting it as input to a spark ignition device diagrammatically indicated at 50. In addition to the output from the transformer 10 the circuit arrangement has a further output provided at terminals 13 for the solenoid controlling the main gas valve of a gas control unit. This unit forms part of the system and is diagrammatically indicated at 51. In the drawing the solenoid is diagrammatically shown and referenced 52; the valve is likewise shown and referenced 53.

The spark ignition device 50 and the gas control unit 51 may be conventional and so are not described or shown in detail, but for the avoidance of doubt it is to be understood that the solenoid is mechanically connected to the valve 53 which is biassed normally closed, and is arranged to open the valve when an electrical energizing signal of sufficient magnitude is applied to it; the spark ignition device has a pair of electrodes 54 between which a spark may be drawn, so as to ignite gas supplied to the burner when the solenoid has operated.

Referring now to the drawing, the circuit shown has live and neutral lines 8,9 with respective terminals L and N for connection across a domestic 240 volt single-phase mains a.c. supply.

Electrically connected immediately adjacent its terminal L the live line 8 includes the normally closed contact 14 of a thermostat which is arranged to monitor the exit water temperature of the boiler heated by the gas burner.

The circuit has a double pole relay with an energizing coil 15 and two movable contacts 15A,15B. The contact 15A is connected to the line 8 and is movable between fixed contacts 15C,15D; the contact 15B is likewise movable between fixed contacts 15E,15F. When the coil 15 is unenergized the relay contacts are engaged in pairs 15A,15C and 15B,15E as shown. The contact 15D may be unconnected or, as shown, it may be connected by a line 37 to a device (not shown) requiring an electrical supply when the burner is alight.

Two thermistors, one (16) having a negative temperature coefficient of resistance and the other (17) having a positive temperature coefficient of resistance, are connected in series with one another between the contact 15C and a junction point 18 to which the contact 15E is also connected. At normal ambient temperatures (e.g., 0° C. to 30° C.) the thermistor 16 has a substantially higher resistance than the thermistor 17. Typically at 20° C. the resistance of the thermistor 16 is 5 kilohms and that of the thermistor 17 is 200 ohms.

The terminals 13 for the solenoid 52 are connected between the movable contact 15B and the neutral line 9, so as to be energized through the thermistors 16,17 when the relay coil 15 is unenergized.

The spark ignition transformer 10 forms part of a spark ignition circuit which is generally indicated by the block referenced 7. Like the terminals 13, this circuit is also arranged for energisation through the thermistors 16 and 17, being connected between the junction point 18 and the neutral line 9. It includes a thyristor 19 having the primary winding 11 of the spark ignition transformer connected in series with its anode-cathode path, and having a load resistor 20 in its anode circuit. A further resistor 21 is arranged for controlling the gate potential of the thyristor 19. A capacitor 22 connects the thyristor anode to the neutral line 9 so as to charge up during each period of non-conduction of the thyristor, and discharge through the primary winding 11 when the thyristor is subsequently fired. In this way the capacitor 22 increases the electrical energy supplied to the spark ignition device 50.

Also shown in the drawing are two loading resistors 35,36 for providing a controlled reduction in the current supplied to the solenoid 52 via the thermistors 16,17. By suitable choice of the temperature-resistance characteristics of the thermistors and the operating current required by the solenoid, these resistors may, however, be dispensed with.

Instead of the energisation through the thermistors 16, 17 as described above, the terminals 13 for the solenoid 52 may also be energised through an alternative path which includes a resistor 23. As is later to be described, this path becomes operative when the relay coil 15 is energized and the contact 15B moves to engage the contact 15F.

For controlling the energization of the relay coil 15 the circuit has three PNP transistors 24,25 and 26 connected in cascade across a capacitor 27 and zener diode 28 in parallel, so as to receive the voltage across those items. In known manner the transistor 24 is arranged to act essentially as an amplifier, the transistors 25,26 acting in combination as a switch controlled by this amplifier.

The capacitor 27 and zener diode 28 are connected across the mains supply in series with a resistor chain 29 and a diode 30, the voltage supplied to the transistors accordingly being half-wave rectified, smoothed and voltage limited. The various resistors and capacitors which are shown in the drawing but not separately described or referenced are provided for determining the correct voltage levels for the transistors etc., and/or for smoothing.

The relay coil 15 is connected in series with the collector-emitter path of the transistor 26, so as to be energised in response to a small d.c. signal which is provided on a line 31 by a flame detection probe 55 when the burner is alight.

For the following description of the operation of the circuit it will be initially assumed that a period of normal shut-down is in progress. The thermostat contact 14 is therefore open and the thermistors 16,17 are at ambient temperature. Accordingly the relay coil 15 and the spark ignition transformer 10 are unenergized; moreover, no potential exists at the terminals 13 so that the valve 53 is closed by the solenoid 52, and no gas passes to the burner.

Subsequent closing of the thermostat 14 when a demand for heat exists therefore occurs with the movable relay contacts 15A,15B at the positions shown. The solenoid 52 and the spark ignition circuit 7 are thereby supplied in parallel through the thermistors 16 and 17 in combination.

Initially, the negative temperature coefficient thermistor 16 has a high resistance such that in combination with the thermistor 17 (which at this time is of substantially smaller resistance) it allows only a small current to pass to the solenoid; the magnitude of this current is insufficient to operate the solenoid, so that the valve 53 remains closed.

The current passing through it, however, has the effect of heating the thermistor 16 so progressively reducing its resistance. Therefore, despite a small increase in the resistance of the thermistor 17 during this time, the combined resistance of the two thermistors falls and continues to do so until the current supplied to the solenoid is sufficiently large to operate the solenoid and so open the valve 53 to allow gas to the burner.

The spark ignition circuit 7 is also supplied with an increasing current in parallel with the solenoid, on the half-cycles of the applied a.c. supply when the thyristor 19 is conductive. By the time that the solenoid operates this current is sufficient to cause the spark ignition device 50 to operate, so that the gas allowed by the valve 53 to pass to the gas burner is, under normal circumstances, ignited as soon as it enters the burner.

Prior to ignition, the transistor 25 is biassed to its conducting state but the transistors 24 and 26 are non-conducting so that the relay coil 15 is unenergized. The appearance of the flame at the burner on ignition, however, causes a small d.c. current to appear on the line 31 via the flame detection probe 55. This current has the effect of turning on the transistor 24, so turning off the transistor 25 and correspondingly turning on the transistor 26. The relay coil 15 therefore becomes energised, so switching the associated contacts 15A and 15B onto the contacts 15D and 15F respectively.

The switching over of the contact 15A deenergizes the spark ignition circuit 7, and the associated spark ignition device 50 therefore ceases operation.

The switching over of the contact 15B connects the resistor 23 into circuit in series with the solenoid 52 in place of the two thermistors 16,17. The value of the resistor 23, although probably greater than the current value of the combined resistance of the thermistors 16,17 at this time, is nevertheless sufficiently low for the solenoid current to maintain the solenoid in its operated condition, so that gas still passes to the burner as before. The burner therefore operates until the demand for heat has been met. The thermostat contact 14 then opens to deenergise the solenoid and so close the valve 53, and at the same time to deenergize the relay coil 15 so that its movable contacts 15A,15B revert to their original positions as shown in the drawing. The circuit is then ready for the next period of operation as described above.

In the event of failure of the burner to ignite when the thermostat contact 14 has closed and the solenoid has subsequently operated to open the valve 53 as described, the non-energisation of the relay coil 15 leaves the solenoid 52 still in series connection with the thermistors 16,17.

Whereas the resistance of the negative temperature coefficient thermistor 16 reduces substantially linearly with temperature over the whole range of operating temperatures of the thermistor 16, the resistance of the positive temperature coefficient thermistor 17 increases only slowly until a predetermined temperature is reached, whereupon it quickly changes with temperature to a high resistance state. The thermistor 17 reaches the elbow in its characteristic a considerable time after the solenoid has operated. After the elbow is reached, the combined series resistance of the two thermistors rises rapidly until it becomes so large that the current through the solenoid is unable to hold the solenoid in its operated condition; the solenoid therefore reverts to its non-operated condition and closes the valve 53.

It will thus be understood that the circuit arrangement shown and described provides two time periods in succession. The first of these time periods occurs in normal operation between the closing of the thermostat contact 14 and the subsequent operation of the main gas valve by a solenoid current of appropriate magnitude. Although typically of the order of only a fraction of a second it is equal to or longer than the time taken for the relay to operate, and so ensures that in the unlikely event of the thermostat contact 14 closing when a flame is still present at the burner the solenoid cannot be briefly energized by a current of sufficient magnitude and duration to operate it. After the relay has operated, the solenoid current is determined by the resistor 23 and so, as previously mentioned, is insufficient to operate the solenoid. The valve 53 therefore remains closed indefinitely until a new and correct start-up procedure takes place.

The second time period, typically of 8 seconds duration, is available after the main gas valve has opened and allows ample time for normal ignition to occur. If at the end of this time the burner has still not ignited the main gas valve is closed and remains so until a mains supply switch (not shown) is opened to deenergise the circuit and so allow the thermistors 16,17 to cool down. After the ignition fault has been corrected the mains supply switch is closed and a start-up procedure as described above ensues, the thermostat contact 14 already being closed.

For reasons of safety it is desirable that the second time period—sometimes referred to as the valve lift time becasue it represents the time during which the main gas valve is lifted from its seat—should be considerably shorter when the attempt to ignite the burner is made while the burner and its environment are still hot after a previous period of operation, than when starting up from cold after a long period of shutdown is required. A particular feature of the circuit arrangement shown and described is that it achieves this desideratum automatically. The positive temperature coefficient thermistor 17, which largely determines the valve lift time, is subject to the burner environment. It will reach the elbow of its characteristic in a time which varies with its own initial temperature. The hotter it is initially, the shorter will be the time it takes to reach the elbow, and consequently the shorter will be the valve lift time.

In this way the described arrangement provides a valve lift time which is neither unacceptably long at high temperatures (e.g., 60° C.), so possibly leading to an explosion hazard, nor unnecessarily short at lower temperatures (e.g., 0° C.). Furthermore, the positive temperature coefficient thermistor 17 provides compensation for variations in the voltage of the mains a.c. supply, and voltage variations of between +10% and −15% of a declared 240 volts supply can be tolerated.

One characteristic of a positive temperature coefficient thermistor is that in the event of failure it always moves to an open-circuit condition. In both of the described circuit arrangements the thermistor is in series with the solenoid, and in the event of failure of the positive temperature coefficient thermistor the system is therefore fail-safe.

Referring now to FIG. 2, the second embodiment of the invention is a modification of the first and operates essentially in the manner previously described. Where appropriate, the same reference numerals as before are used to indicate like or analogous parts.

Instead of the items 27 to 30 of the first circuit the circuit of FIG. 2 has a transformer 38 with its primary winding 39 connected between the live and neutral lines 8,9. The secondary winding 40 of the transformer is connected across the collector-emitter paths of the transistors 24 to 26 through a diode 41 which provides the required rectification. A capacitor 27 again provides smoothing.

The circuit supplied from the transformer secondary winding 40 and including the transistors 24 to 26 is tied to earth potential by an earth connection 70.

Further differences between the circuit arrangements of FIGS. 1 and 2 lie in the omission of the loading resistors 35, 36 from the second circuit arrangement and the provision for the second circuit arrangement of a spark ignition circuit 7 such that sparking is inhibited automatically if a flame is present at the burner. Because of this feature the switch provided in FIG. 1 by the contact 15A in cooperation with the contact 15C is made redundant, and so is omitted.

To achieve the inhibition of sparking on ignition, the gate of the thyristor 19 (FIG. 2) is connected, in series with a neon tube 60, to a junction point 61 between a resistor 62 and a capacitor 63, so that the neon tube 60 is in series with resistor 62. Also in series with resistor 62 are a diode 67 and a resistor 66, while the capacitor 63 is in parallel with the neon tube 60, being connected between the junction point 61 and the neutral line 9. The capacitor 22 is connected between the neutral line 9 and a junction point 65, the latter being between the diode 67 and resistor 62. The primary winding 11 of the spark ignition transformer 10 is connected between the anode of thyristor 19 and the junction point 65, while its secondary winding 12 is connected between the junction point 61 and an output terminal 64 of the spark ignition device 50.

The resistor 66 is connected between the anode of diode 67 and the junction point 18 of resistor 16 and switch contact 15E. Thus, when a.c. is applied at junction point 18, a half-wave rectified a.c. voltage is developed by diode 67 to charge both the capacitors 22 and 63. When the voltage across capacitor 63 reaches the break-over or strike voltage of the neon tube 60, the latter conducts, so causing the thyristor 19 to conduct. This excites the primary transformer winding 10 so that a current generated in secondary winding 12, causes a spark to appear between the electrodes 54.

When the spark successfully ignites the gas, the resulting flame creates, across the spark electrodes 54, a relatively low resistance leakage path which prevents the capacitor 63 from being charged to the strike voltage of neon tube 60. Thus, when there is a flame no spark can be generated across the electrodes 54.

However, should the burner flame be extinguished, then so long as there is an a.c. voltage at the junction point 18, the voltage across capacitor 63 will rise and a spark will be generated for re-ignition.

In a modification of the described circuit arrangements the spark ignition circuit 7 is connected (or connectible) directly across the lines 8,9 rather than in series with the thermistors 16,17. Alternatively the circuit 7 may be connected across the a.c. supply in series with only the positive temperature coefficient thermistor 17.

As previously described, the time delay provided by the negative temperature coefficient thermistor 16 between the closing of the thermostat contact 14 and the subsequent operation of the solenoid ensures that the solenoid cannot be operated in the unlikely event that a flame is already present (or is sensed in error) at the time of closing of the thermostat contact. In a possible modification of each of the circuit arrangements of FIGS. 1 and 2 the thermistor 16 is omitted. Alternatively, the time delay may be introduced by other means.

In both of the described circuit arrangements all the components except the relay are solid state devices, and the whole circuit arrangement including the relay may be formed into a moulded unit, so providing considerable mechanical strength, protection against humidity and shock, ease of replacement and tamper resistance. Having regard to the large number of safety features which each circuit arrangement provides, the number of components required is small; the moulded unit may be correspondingly compact and so can be readily mounted on the gas control unit 51 in the gas supply line to the burner.

Although particularly described in relation to a series arrangement of solenoid and thermistor(s), a parallel or series-parallel arrangement may alternatively be possible. Moreover, devices other than thermistors may be used to effect the required variation of the solenoid current.

We claim:

1. A control system for a gas burner, which comprises a normally closed valve for controlling the gas supply to the burner, and an electric solenoid connected to the valve, the solenoid being arranged for actuating the valve to its open condition when energized with a current of at least a first predetermined value, but capable of holding the valve open when energised with a current of at least a second predetermined value lower than the first, the system further including an electric circuit for energizing the solenoid from an electric supply and including solid-state variable impedance means connected in circuit relation to the solenoid and arranged, on operation of the solenoid to open the valve, for controlling the solenoid current to decrease progressively from the first said predetermined value to below the second said predetermined value over a time period of substantial length, unless during said time period the burner is successfully ignited in which case the electric circuit is arranged to maintain the solenoid current at at least the second said predetermined value.

2. A control system for a gas burner, which comprises a normally closed valve for controlling the gas supply to the burner, and an electric solenoid connected to the valve, the solenoid being arranged for actuating the valve to its open condition when energized with a current of at least a first predetermined value, but capable of holding the valve open when energized with a current of at least a second predetermined value lower than the first, the system further including an electric circuit for energizing the solenoid from an electric supply and including solid-state temperature-responsive variable impedance means connected in circuit relation to the solenoid and arranged, on operation of the solenoid to open the valve, for controlling the solenoid current to decrease progressively from the first said predetermined value to below the second said predetermined value over a time period of substantial length, unless during said time period the burner is successfully ignited in which case the electric circuit is arranged to maintain the solenoid current at at least the second said predetermined value.

3. A control system according to claim 2, wherein the temperature-responsive impedance means comprises a thermistor having a positive temperature coefficient of resistance and connected in series with the solenoid.

4. A control system according to claim 3, which includes a further thermistor having a negative coefficient of resistance and connected in series with the first thermistor and the solenoid, the further thermistor having a substantially higher initial resistance than the first thermistor and arranged, subsequent to energization of the solenoid from a said electric supply, to introduce a delay in the operation of the solenoid by temporarily controlling the solenoid current to below the first said predetermined value.

5. A control system according to claim 2, which includes a second impedance means, and switching means response to a signal indicative of burner ignition for switching the second impedance means into circuit relation with the solenoid whereby to maintain the solenoid current at at least the second said predetermined value.

6. A control system according to claim 3, wherein the electric circuit has a relay arranged to operate in response to a signal indicative of burner ignition, and a resistance connectable in series with the solenoid by a contact of the relay, the resistance being of a value, when so connected, to maintain the solenoid current at at least the second said predetermined value.

7. A control system according to claim 3 having a spark ignition device for igniting the burner, the electric circuit being arranged for deriving energization for the spark ignition device from an a.c. electric supply through the positive temperature coefficient thermistor.

8. A control system according to claim 4 having a spark ignition device for igniting the burner, the electric circuit being arranged for deriving energization for the spark ignition device from an a.c. electric supply through the positive and negative temperature coefficient thermistors in series.

9. A control system according to claim 4 having a spark ignition device for igniting the burner, the electric circuit including a transformer having a high voltage secondary winding connected to the spark ignition device, a thyristor having its anode-cathode path in series with the primary winding of the transformer for controlling the energization of the same, and gate biassing means connected to the thyristor gate electrode and arranged to control the thyristor to conduction every half cycle of an applied a.c. electrical supply.

10. A control system according to claim 9, wherein the gate biassing means is electrically associated with the spark ignition device so as to be automatically inhibited from operation when a burner flame is present.

11. A control system according to claim 6, which includes a spark ignition device for igniting the burner, the electric circuit including a transformer having a high voltage secondary winding connected to the spark ignition device, a thyristor having its anode-cathode path in series with the primary winding of the transformer for controlling the energisation of the same from an a.c. supply, and gate biassing means connected to the thyristor gate electrode and arranged to control the thyristor to conduction every half cycle of the said supply, the relay having a further contact arranged on ignition of the burner to open-circuit the series path of the thyristor and transformer primary winding.

12. A control system for a gas burner, comprising in combination:

a normally closed valve for controlling supply of burner gas and solenoid means associated with said valve for opening same in response to current of at least a first predetermined value supplied thereto and for holding said valve in open condition in response to current of at least a second predetermined value which is less than said first predetermined value;

variable impedance means connected to said solenoid for supplying current thereto which initially exceeds said first predetermined value but progressively decreases therefrom over a time delay period to a value less than said second predetermined value whereby the action of said variable impedance means is initially to open said valve and then hold it open for said time delay period; and gas ignition detecting means for supplying current to said solenoid independently of said variable impedance means which is at least equal to said second predetermined value but is less than said first predetermined value in response to ignition of gas supplied by said valve whereby gas ignition prior to termination of said time delay period maintains said valve in open condition.

* * * * *